United States Patent [19]

Granzow

[11] 4,122,700

[45] Oct. 31, 1978

[54] PROCESS FOR FORMING SHEET METAL STOCK

[75] Inventor: Wayne G. Granzow, Middletown, Ohio

[73] Assignee: Armco Steel Corporation, Middletown, Ohio

[21] Appl. No.: 790,195

[22] Filed: Apr. 25, 1977

Related U.S. Application Data

[63] Continuation-in-part of Ser. No. 719,950, Sep. 2, 1976, abandoned.

[51] Int. Cl.[2] ..... B21D 22/20

[52] U.S. Cl. ..... 72/342; 113/120 H

[58] Field of Search ..... 72/342; 113/120 H

[56] References Cited

U.S. PATENT DOCUMENTS

| | | | |
|---|---|---|---|
| 1,580,931 | 4/1926 | Thackray | 72/342 |
| 3,902,348 | 9/1975 | Hale | 72/379 |

FOREIGN PATENT DOCUMENTS

| | | | |
|---|---|---|---|
| 1,506,899 | 11/1967 | France | 72/342 |

*Primary Examiner*—Lowell A. Larson

*Attorney, Agent, or Firm*—Melville, Strasser, Foster & Hoffman

[57] ABSTRACT

A process for forming sheet metal material having a yield strength and tensile strength which are sensitive to small changes in temperature at ambient conditions, wherein an unheated sheet metal workpiece is drawn between a concave die cavity and a mating convex punch by relative movement therebetween into the internal configuration of the die, and wherein the workpiece is selectively cooled in those areas which are susceptible to breakage. Cooling may be effected by cooling portions of the punch, or in complex part designs by cooling localized portions of the die, or both. The amount of cooling is relatively slight and may be only that required to remove heat generated by plastic deformation of the workpiece in the areas susceptible to breakage.

5 Claims, 3 Drawing Figures

PROCESS FOR FORMING SHEET METAL STOCK

CROSS-REFERENCE TO RELATED APPLICATIONS

This application is a continuation-in-part of application Ser. No. 719,950 filed Sept. 2, 1976 in the name of Wayne G. Granzow and entitled PROCESS FOR FORMING SHEET METAL STOCK, now abandoned.

BACKGROUND OF THE INVENTION

1. Field of the Invention

This invention relates to a process for forming sheet metal stock, by engaging an unheated sheet metal workpiece between a concave die and a mating convex punch which are caused to move relative to one another, thereby drawing the workpiece into the internal configuration of the die. The process has utility in the drawing of hot rolled or cold rolled sheet metal stock whose yield strength and tensile strength are sensitive to small changes in temperature during a drawing operation, particularly under ambient conditions.

2. Description of the Prior Art

In extrusion type metal forming operations, wherein compression is applied on the metal being formed, it is customary to heat the workpiece to a relatively high temperature in order to reduce the press load. In such operations, the provision of means for cooling or chilling parts of the extrusion apparatus, particularly the punch, to prevent thermal distortion and/or excessive wear, is known in the art, as exemplified in U.S. Pat. Nos. 3,740,990 to Prajsnar et al. 3,200,625 to Wehmeyer and 3,808,865 to Wagner et al.

U.S. Pat. No. 3,196,648 issued to Molnar, discloses an impact extrusion process wherein the punch is provided with outwardly extending passages which exit from the wall of the punch behind the head thereof, through which pressurized gas is caused to flow during the forming operation. It is stated that this process results in elimination of frictional restraint between the punch, die and the part being formed during the extrusion and stripping. Rapid heat transfer results in cooling of the metal in the formed walls, thereby increasing the strength thereof sufficiently to support loads imposed by friction.

The prior art has thus disclosed the cooling of the punch or other parts in a hot impact extrusion process.

Sheet metal forming is not analagous to hot extrusion. In an extrusion process the forming stresses on a heated workpiece are compressive, so that it cannot fail from the softening imparted by the heating. The only limit on the amount of heat which can be used is the increased wear on the tooling and possible thermal distortion. On the other hand, in sheet metal forming, the stresses imposed on the workpiece, e.g., during a simple cup-forming operation, include tension in the side wall, straightening, and bending, in different areas. With the exception of a small group of brittle alloys which must be heated above their recrystallization temperature to become ductile, the workpiece is never heated since the walls must support the entire forming load. Heating would not only reduce wall strength, but would also decrease the effectiveness of the lubrication used to reduce friction. On the other hand, some heat is unavoidably generated by the plastic deformation in the sheet metal workpiece and by friction between the workpiece and the die. Much of this heat is absorbed by the relatively massive tooling.

In the field of sheet metal forming and drawing, a book entitled "Deformation Processing" (published in 1972) refers at pages 236 and 237 to the possibility of raising the drawing limit by strengthening "the potential failure site. . . relative to the deformation zone where the load originates." There are mechanical and metallurgical possibilities. Metallurgically, the possibilities relate "to the controlled yield-locus distortion." It is pointed out the deformation in the flange is pure shear while deformation around the punch is essentially plane strain with each being related to the yield-locus. To raise the drawing limit "the failure site should be strengthened by increasing its path length through quadrant I relative to that of the flange through quadrant IV (FIG. 11-9)." It is then stated:

"An obvious possibility is a temperature drop, from flange to cup wall. Another is an increase in the anisotropy parameter, B,. . . or the more usual R. . . which are both connected to crystallographic texture. . . "

French Pat. No. 1,506,899 relates to the hot drawing of alloy sheet material (such as aluminum, zinc and/or magnesium alloys) which must be heated above the recrystallization temperature (175°-315° C.) in order to be drawn. In the process of this patent, the punch of the press is cooled while the die is kept at the hot drawing temperature by heating. This concept is thus similar to that of the previously mentioned U.S. Pat. No. 3,196,648, although applied to drawing rather than impact extrusion.

U.S. Pat. No. 2,396,218 discloses the drawing of a magnesium alloy sheet material which is heated to a temperature between 400° and 700° F., wherein the punch is cooled. This disclosure is quite similar to that of the above-mentioned French patent.

U.S. Pat. No. 3,577,753 discloses a drawing method and apparatus wherein an internally fluid-cooled punch and fluid-cooled dies are provided in order to prevent thermal break-down of dry film lubricant coating on the sheet metal workpiece.

The mechanism of draw forming cold rolled, low carbon steel sheet is still not fully understood, and problems exist in the deep drawing of such sheet material, despite recent advances in composition and processing which provide a more favorable grain texture. The concept of heating of the workpieces, as taught in the above French Pat. No. 1,506,899 and U.S. Pat. No. 2,396,218, while effective for hard and brittle sheet material such as aluminum-magnesium alloys and titanium, has been found to decrease the formability of ductile and malleable sheet material such as cold rolled low carbon steel. Heating results in break-down of conventional drawing lubricants with a resulting danger of scoring of the drawn parts. Since the surface appearance of drawn sheet metal parts is usually critical, scoring, pinching and oxide scaling cannot be tolerated. Cooling of all tooling as taught in U.S. Pat. No. 3,577,753, increases the strength of the workpiece in the areas which must be plastically deformed. This increases the load on the sidewalls of the part being drawn, which leads to failure.

SUMMARY

It is a principal object of the present invention to provide a sheet metal forming process which produces deeper draws in sheet metal stock whose yield strength and tensile strength are sensitive to small changes in temperature under ambient conditions, while avoiding the above-mentioned problems associated with conventional draw forming.

The present invention constitutes a discovery that adiabatic heating in localized areas of a workpiece, generated by plastic deformation and/or friction, significantly weakens such critical area and results in failure or breakage. This problem is overcome by selective cooling of those critical areas where adiabatic heating occurs, in accordance with the process of the invention. Since the process is conducted at room temperature the cooling may be sufficient only to remove the heat which is generated, without necessarily reducing the temperature of the critical areas of the workpiece or the die or punch parts in contact therewith below ambient temperature. In other words, no specific temperature differential is required, so long as the heat which has been generated abiabatically is removed.

According to another embodiment of the invention excellent results have been obtained by cooling the punch at least in localized areas thereof in contact with those critical areas of the workpiece susceptible to breakage to a temperature at least about 5 celsius degrees cooler than the die.

According to the invention there is thus provided a process for forming sheet metal in thicknesses up to about 6.5 mm, wherein an unheated sheet metal workpiece is engaged between a concave die and mating convex punch which are caused to move relative to one another whereby to draw said workpiece, by direct contact with said punch, into the internal configuration of said die, and wherein those areas of the workpiece susceptible to breakage are selectively cooled. Preferably the cooling strengthens these critical areas by removal of the heat generated by plastic deformation of the workpiece.

The present process is broadly applicable to any sheet metal, in thicknesses up to about 6.5 mm, whose yield strength and tensile strength are sensitive to small changes in temperature under the ambient temperature conditions encountered in stamping and drawing operations. By way of non-limiting example, it has been found that hot rolled and cold rolled low carbon rimmed, aluminum-killed, and columbium-treated steels; and some stainless steels such as AISI Type 301, are sensitive to temperature changes of only a few degrees in a stamping operation. Some other substantially pure metals, such as copper, would probably also exhibit such sensitivity.

In prior art processes for forming hard and brittle metals the metal is heated to about one-third of the melting point of the metal (about 205° C. for aluminum-magnesium alloys) in order to soften the workpiece sufficiently to permit forming. This of course also weakens the workpiece so that it pulls apart easily, and it is therefore necessary to remove some of the heat at critical areas in order to form it. In contrast to this, the present process is conducted at room temperature, with no heat added, and the heat generated adiabatically in localized areas is removed.

BRIEF DESCRIPTION OF THE DRAWINGS

Reference is made to the accompanying drawing wherein.

DESCRIPTION OF THE PREFERRED EMBODIMENTS

Figure 1:
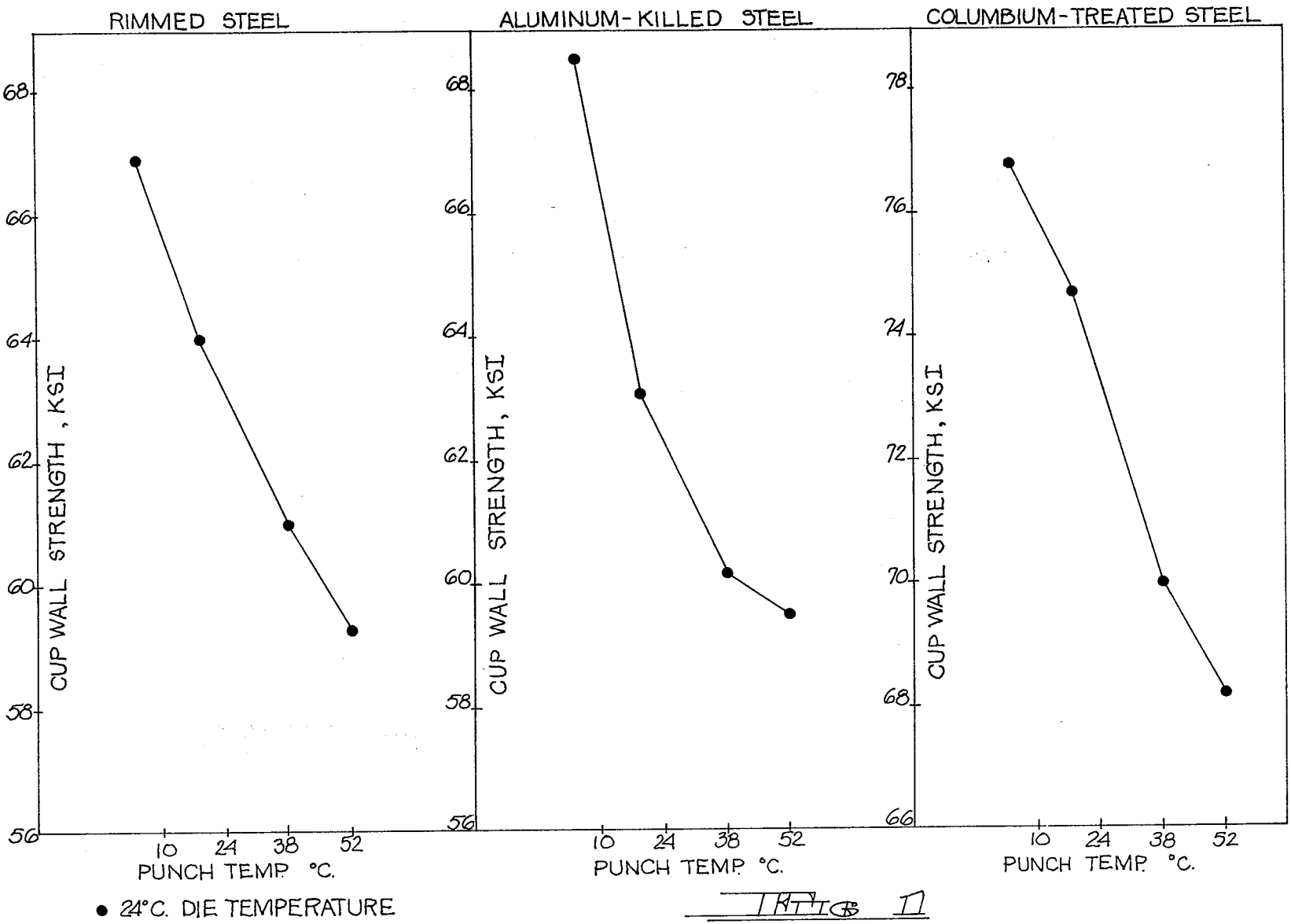
FIG. 1 is a graphic representation of cup wall strength vs. punch temperature with dies at room temperature for three types of low carbon, cold rolled steel sheet.

Referring to FIG. 1, the effect on cup wall strength as a function of the temperature differential between the die and the punch is plotted for three types of steel sheet. It will be noted that the difference in wall strength between a punch temperature of 10° C. and 24° C. is about 2500 psi for a rimmed steel. For aluminum-killed steel and columbium treated steel, the same temperature differential results in an even more striking difference in cup wall strength, being on the order of 4000 and 3000 psi, respectively. It is apparent that cup wall strength is thus an almost inverse linear function of punch temperature, and hence any decrease in punch temperature adds an incremental increase to the cup wall strength. In other words, any decrease in punch temperature in contact with a localized area of the workpiece which is susceptible to failure increases the depth to which a cup can be drawn. According to FIG. 1 the increase in cup wall strength ranges from about 175 to about 280 psi for each decrease of about 1° C. within the temperature range of 10° to 52° C. for a die temperature of 24° C.

Figure 2:
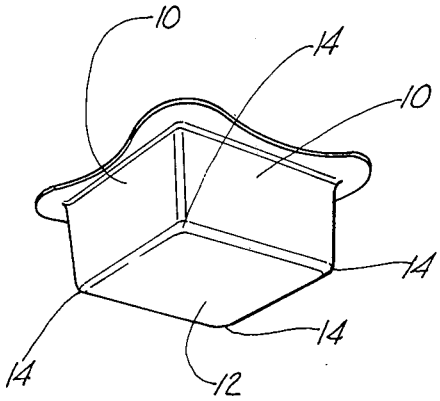
FIG. 2 is a perspective view of a drawn box-form sheet metal part.

FIG. 2 represents a simple drawn box-formed part having side walls 10, bottom 12 and corners 14. In a drawing operation of this type the areas susceptible to breakage occur at each of the four corners 14. Cooling applied to the punch in contact with each of the four areas 14 would prevent breakage in the corners and permit a deeper draw.

Figure 3:
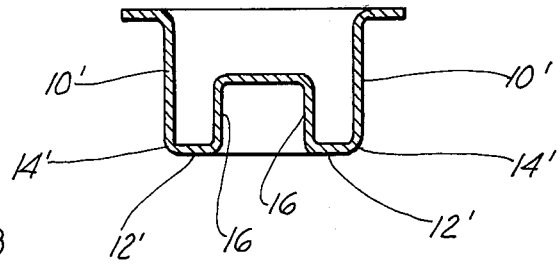
FIG. 3 is a sectional view of a cylindrical cupform sheet metal part subjected to two drawing operations.

FIG. 3 represents a compound or two-draw operation, wherein a cup-formed cavity is first formed having sidewalls 10' and bottom 12'. The radius 14' would be the area in which breakage might occur, and this could be avoided by cooling the portions of the punch in contact with area 14'.

A second cavity is formed as a further step by a protrusion or punch in the die, having sidewalls 16. In this operation breakage is most likely to occur in the sidewall 16, and therefore cooling of the protrusion of the die which forms the second cavity would avoid breakage in this step of the operation.

When a part is being formed in a sheet metal press, the first deformation of the metal in the workpiece occurs between the die radius and the punch nose radius, since this is the only part of the workpiece which is not supported by friction with the tooling. Tests have shown that this metal may stretch as much as an inch before it work hardens sufficiently to start drawing metal in from between the blankholder and the die. As this metal stretches it becomes very hot, and this heating greatly reduces the tensile strength. This stretched area always becomes the thinnest part of the drawn piece, and the amount of heating determines to a great extent how thin it becomes. When this critical area is cooled by cooling the punch in contact therewith, it remains thicker and is thus better enabled to support the forming load. A significant point here is that the area which fails in the cup test is never in contact with the die, and that the improvement in thickness occurs before any metal has been pulled in from between the die and the blankholder.

Moreover, if an area which is susceptible to failure can be cooled, it will be strengthened and the strain will be distributed over a larger area, even in situations where the flange is firmly held, as in a stretch-forming operation. Again, this is independent of die temperature.

Tests have been conducted in a hydraulic press using a 101.6 mm diameter cup die with a modified hollow punch of 12.7 mm wall thickness having an inlet and outlet for coolant liquids, which may be water, ethylene glycol, or the like.

Three different grades of cold rolled, low carbon steel sheets were tested in thickness ranging from 0.76 to 1.02 mm. These grades have plastic strain ratios * generally ranging from about 0.9 to about 2.2. The sheets were sheared into round blanks, and the largest blank which could be successfully drawn into a 101.6 mm diameter cup was determined for each grade under a variety of punch and die temperature conditions. It will of course be understood that the diameter of the blank is also a direct indication of the draw depth, i.e., the greater the blank diameter, the greater the draw depth. * average plastic strain ratio ($r_m$)= $\frac{1}{4}$ [$r$ (longitudinal) + $r$ (transverse) + 2$r$ (diagonal)]

The results of these tests are summarized in Table I, from which it will be noted that a rimmed steel (with an average plastic strain ratio of 1.26) exhibited optimum results at a punch temperature of −7° C. with a die temperature of 21° C. and a punch temperature of +4° C. with a die temperature of 52° C. In the case of an aluminum-killed low carbon steel sheet (average plastic strain ratio of 1.65), optimum results were obtained at punch temperatures of −7° and +4° C. with a die temperature of 21° C. In the case of cold rolled IF steel, a vacuum degassed, columbium-treated steel having a composition in accordance with U.S. Pat. Nos. 3,761,324 and 3,765,874, issued to Elias and Hook (average plastic strain ratio of 2.10) optimum results were obtained with a punch temperature of −7° C. and a die temperature of 21° C., with excellent results being obtained at punch temperatures of +4° C. and +18° C. at a die temperature of 38° C., and punch temperatures of +4° C. and +18° C. at a die temperature of 52° C.

In the above described tests and maximum ram speed was too slow to generate any noticeable heat buildup in the die, and hence, heaters were attached to the periphery of the die and blankholder in order to simulate the normal heat buildup which would occur at commercial operating speeds, i.e., up to about 52° C. It will of course be understood that in the preferred practice of the invention under commercial operating conditions, there would be no need to supply heat to the die since a normal heat buildup would occur. Ordinarily this heat buildup would not exceed about 55° C. for workpiece thicknesses up to about 2.5 mm. However, for greater thicknesses, up to about 6.5 mm, die temperatures may reach about 100° C.

TABLE I

| Low Carbon Steels | | | | | |
|---|---|---|---|---|---|
| Diameter (mm) of largest workpiece which could be successfully drawn into cylindrical cup (101.6mm) | | | | | |
| Die Temp. ° C | Punch Temperature ° C | | | | |
| | −7 | +4 | +18 | +38 | +52 |
| | Rimmed (0.76 to 1.02 mm) - $r_m$ 1.26 | | | | |
| 21 | 228.6 | 222.3 | 215.9 | 209.6 | 209.6 |
| 38 | — | 222.3 | 215.9 | 209.6 | 209.6 |
| 52 | — | 228.6 | 222.3 | 215.9 | 209.6 |
| | A1-killed (0.76 to 1.02 mm) -$r_m$ 1.65 | | | | |
| 21 | 241.3 | 241.3 | 228.6 | 215.9 | 215.9 |
| 38 | — | 235 | 228.6 | 222.3 | 215.9 |
| 52 | — | 235 | 235 | 222.3 | 222.3 |
| | "IF" (0.76 to 1.02 mm) -$r_m$ 2.10 | | | | |
| 21 | 260.4 | 247.7 | 247.7 | 228.6 | 228.6 |
| 38 | — | 254 | 254 | 241.3 | 228.6 |
| 52 | — | 254 | 254 | 241.3 | 228.6 |

$r_m$ = average plastic strain ratio

From the above data, it is evident that an embodiment of the present process, as applied to cold-reduced, low carbon rimmed steel, aluminum-killed steel, or vacuum degassed columbium-treated steel, involves maintaining the punch at a temperature of about −7° C. to about +20° C. with the die being at a temperature of about 21° C. to about 52° C., and maintaining the punch more than 5 celsius degrees cooler than the die.

The minimum thickness of the sheet metal workpiece does not constitute a limitation.

AISI type 301 stainless steel has also been successfully formed in accordance with the invention. Square pans or boxes were produced from cold rolled material of 0.737 and 0.635 mm thickness. Test data are set forth in Table II. A comparison of Part Nos. 1 and 2, both of which were drawn under conventional conditions with the punch at 24° C. (ambient temperature), shows that a 30.48 by 30.48 cm (12 inch × 12 inch) blank of 0.737 mm thickness broke, whereas a 29.21 by 29.21 cm (11½ inch × 11½ inch) blank of the same thickness was successfully drawn. Part No. 3 was a 30.48 by 30.48 cm blank of 0.737 mm thickness drawn in accordance with the invention with the punch water cooled at 18° C., and it was successfully drawn, contrary to the same size blank (Part No. 1) drawn by conventional practice. A comparison of Part No. 4 with Part No. 1 shows that a 20% thinner blank can be drawn satisfactorily by the present process.

TABLE II

| Type 301 Stainless Steel | | | | |
|---|---|---|---|---|
| Part No. | Sheet Thickness (mm) | Blank Dimensions (cm) | Punch Temp. ° C | Result |
| 1 | 0.737 | 30.48 × 30.48 | 24° | Breakage |
| 2 | 0.737 | 29.21 × 29.21 | 24° | Satisfactory |
| 3 | 0.737 | 30.48 × 30.48 | 18° | Satisfactory |
| 4 | 0.635 | 30.48 × 30.48 | 18° | Satisfactory |

Modifications may be made without departing from the spirit and scope of the invention, and no limitations are to be inferred or implied except as specifically set forth in the appended claims.

The embodiments of the invention in which an exclusive property of privilege is claimed are defined as follows:

1. In a process for forming sheet metal in thicknesses up to about 6.5mm of a type exhibiting yield strength and tensile strength sensitivity to small changes in temperature under ambient conditions, wherein a sheet metal workpiece at room temperature is engaged between a concave die and a mating convex punch which are caused to move relative to one another whereby to draw said workpiece, by direct contact with said punch, into the internal configuration of said die, the improvement which comprises selectively cooling those areas of said workpiece to remove adiabatic heat from those critical areas of said workpiece susceptible to breakage.

2. In a process for forming sheet metal in thicknesses up to about 6.5 mm of a type exhibiting yield strength and tensile strength sensitivity to small changes in temperature under ambient conditions, wherein a sheet metal workpiece at room temperature is engaged between a concave die and a mating convex punch which are caused to move relative to one another whereby to draw said workpiece, by direct contact with said punch, into the internal configuration of said die, the improvement which comprises cooling said punch to a temperature of at least about 5 celsius degrees cooler than said die.

3. The improvement claimed in claim 2, wherein said sheet metal is chosen from the class consisting of rimmed steel, aluminum killed steel, and vacuum degassed columbium-treated steel, in the form of hot-reduced or cold-reduced sheet strip stock having an average plastic strain ratio ranging between about 0.90 and about 2.2, and wherein said punch is maintained at a temperature of more than 5 celsius degrees cooler than said die.

4. The improvement claimed in claim 3, wherein said punch is maintained at a temperature of about −7° to about +20° C., and said die is at a temperature of about 21° to about 52° C.

5. The improvement claimed in claim 2, wherein said sheet metal is hot-reduced or cold-reduced stainless steel.

* * * * *